US010701491B2

(12) United States Patent
Alexander

(10) Patent No.: US 10,701,491 B2
(45) Date of Patent: Jun. 30, 2020

(54) FLUID DIODE LOUDSPEAKER

(71) Applicant: Eric Jay Alexander, Orem, UT (US)

(72) Inventor: Eric Jay Alexander, Orem, UT (US)

( * ) Notice: Subject to any disclaimer, the term of this patent is extended or adjusted under 35 U.S.C. 154(b) by 0 days.

(21) Appl. No.: 15/384,296

(22) Filed: Dec. 19, 2016

(65) Prior Publication Data

US 2017/0180872 A1 Jun. 22, 2017

Related U.S. Application Data

(60) Provisional application No. 62/269,022, filed on Dec. 17, 2015.

(51) Int. Cl.
*H04R 23/00* (2006.01)
*H04R 1/28* (2006.01)

(52) U.S. Cl.
CPC ..... *H04R 23/006* (2013.01); *H04R 1/2803* (2013.01)

(58) Field of Classification Search
CPC .... H04R 2460/11; H04R 1/02; H04R 1/1058; H04R 1/1075; H04R 1/2803; H04R 1/2811; H04R 1/2826; H04R 1/2846; H04R 1/2849; H04R 2201/029; H04R 2499/11
See application file for complete search history.

(56) References Cited

U.S. PATENT DOCUMENTS

2004/0173402 A1* 9/2004 Morkerken ..... H04R 1/2826 181/151
2005/0175206 A1* 8/2005 Bearden ..... H04R 1/2826 381/338
2009/0245563 A1* 10/2009 Parker ..... H04R 1/02 381/345
2014/0307032 A1* 10/2014 Xie ..... B41J 2/14064 347/54
2016/0127823 A1* 5/2016 Huang ..... H04R 1/2811 381/345

* cited by examiner

*Primary Examiner* — Sunita Joshi
(74) *Attorney, Agent, or Firm* — Kirton McConkie; Adam D. Stevens

(57) ABSTRACT

A loudspeaker enclosure includes a fluid diode to control air flow into and/or out of the enclosure.

20 Claims, 8 Drawing Sheets

FLUID DIODE LOUDSPEAKER

CROSS REFERENCE TO RELATED APPLICATIONS

This application claims priority to U.S. Provisional Application Ser. No. 62/269,022, which is incorporated herein by reference for all it discloses.

BACKGROUND OF THE INVENTION

1. Field of the Invention

The present invention relates to loudspeakers, and more particularly to incorporation of a fluid diode into the air path of a speaker enclosure.

2. Background and Related Art

Loudspeakers are commonly used to reproduce recorded audio information. Efforts are ongoing to improve performance of loudspeakers' reproduction of recorded audio information.

BRIEF SUMMARY OF THE INVENTION

Implementation of the invention provides a loudspeaker incorporating a fluid diode in the air path of a speaker enclosure, allowing the internal loudspeaker enclosure air density and pressures to be fluidically controlled and cycled through the loudspeaker enclosure. Air may be drawn into the enclosure through one fluid diode, and may be pushed out of the enclosure through a second fluid diode. Such an enclosure breathes fluidically over prior methods of damped spring models, pulsing transmission lines, and pulsing resonating vents.

According to implementations of the invention, a loudspeaker enclosure includes a fluid diode. The fluid diode may be formed between two rigid members. One of the rigid members may be an exterior panel of the loudspeaker enclosure. The fluid diode may be machined into at least one of the rigid members. The fluid diode may be substantially planar.

The loudspeaker enclosure may define an interior and an exterior, and the fluid diode may provide an air channel between the interior and the exterior. The fluid diode may be an inlet fluid diode and the loudspeaker enclosure may further include an outlet fluid diode. The inlet fluid diode and the outlet fluid diode may be substantially coplanar. In some implementations, the loudspeaker enclosure includes four fluid diodes. Two of the fluid diodes may be inlet fluid diodes, and two of the fluid diodes may be outlet fluid diodes.

According to further implementations of the invention, a loudspeaker includes an enclosure defining an interior and an exterior of the enclosure, one or more drivers affixed to the enclosure, and a port venting an interior of the enclosure to an exterior of the enclosure through a fluid diode. The fluid diode may be formed between two rigid members. One of the rigid members may be an exterior panel of the enclosure.

The fluid diode may be an inlet fluid diode and the loudspeaker may further include an outlet fluid diode. The inlet fluid diode and the outlet fluid diode may be substantially coplanar. The loudspeaker may include four fluid diodes. Two of the fluid diodes may be inlet fluid diodes, and two of the fluid diodes may be outlet fluid diodes. Each of the fluid diodes may be in fluid communication at a first end with a port of the enclosure and in fluid communication at a second end with the interior of the enclosure.

According to still further implementations of the invention, a loudspeaker includes an enclosure defining an interior and an exterior of the loudspeaker, one or more drivers affixed to the enclosure and having an open back in fluid communication with the interior of the enclosure. The loudspeaker further includes an inlet port venting the interior of the enclosure to the exterior of the loudspeaker through a first fluid diode arranged to have increased resistance to air flow out of the enclosure through the first fluid diode as compared to air flow into the enclosure through the first fluid diode and an outlet port venting the interior of the enclosure to the exterior of the loudspeaker through a second fluid diode arranged to have increased resistance to air flow into the enclosure through the second fluid diode as compared to air flow out of the enclosure through the second fluid diode. The inlet port may be a first inlet port and the outlet port may be a first outlet port, and the loudspeaker may further include a second inlet port venting the interior of the enclosure to the exterior of the loudspeaker through a third fluid diode arranged to have increased resistance to air flow out of the enclosure through the third fluid diode as compared to air flow into the enclosure through the third fluid diode and a second outlet port venting the interior of the enclosure to the exterior of the loudspeaker through a fourth fluid diode arranged to have increased resistance to air flow into the enclosure through the fourth fluid diode as compared to air flow out of the enclosure through the fourth fluid diode.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
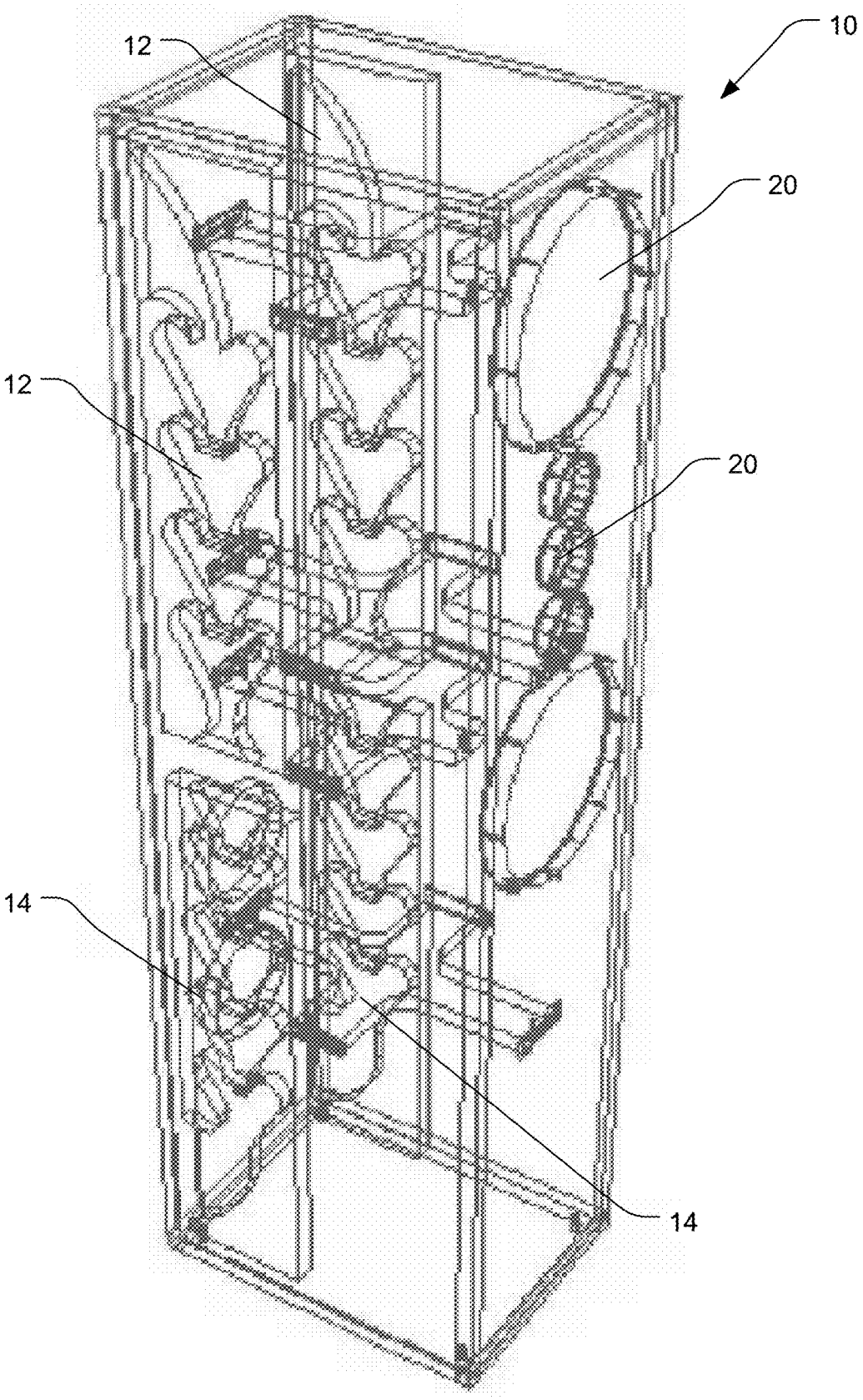
FIG. 1 shows a perspective plan view of a speaker enclosure incorporating fluid diode vents.
Figure 2:
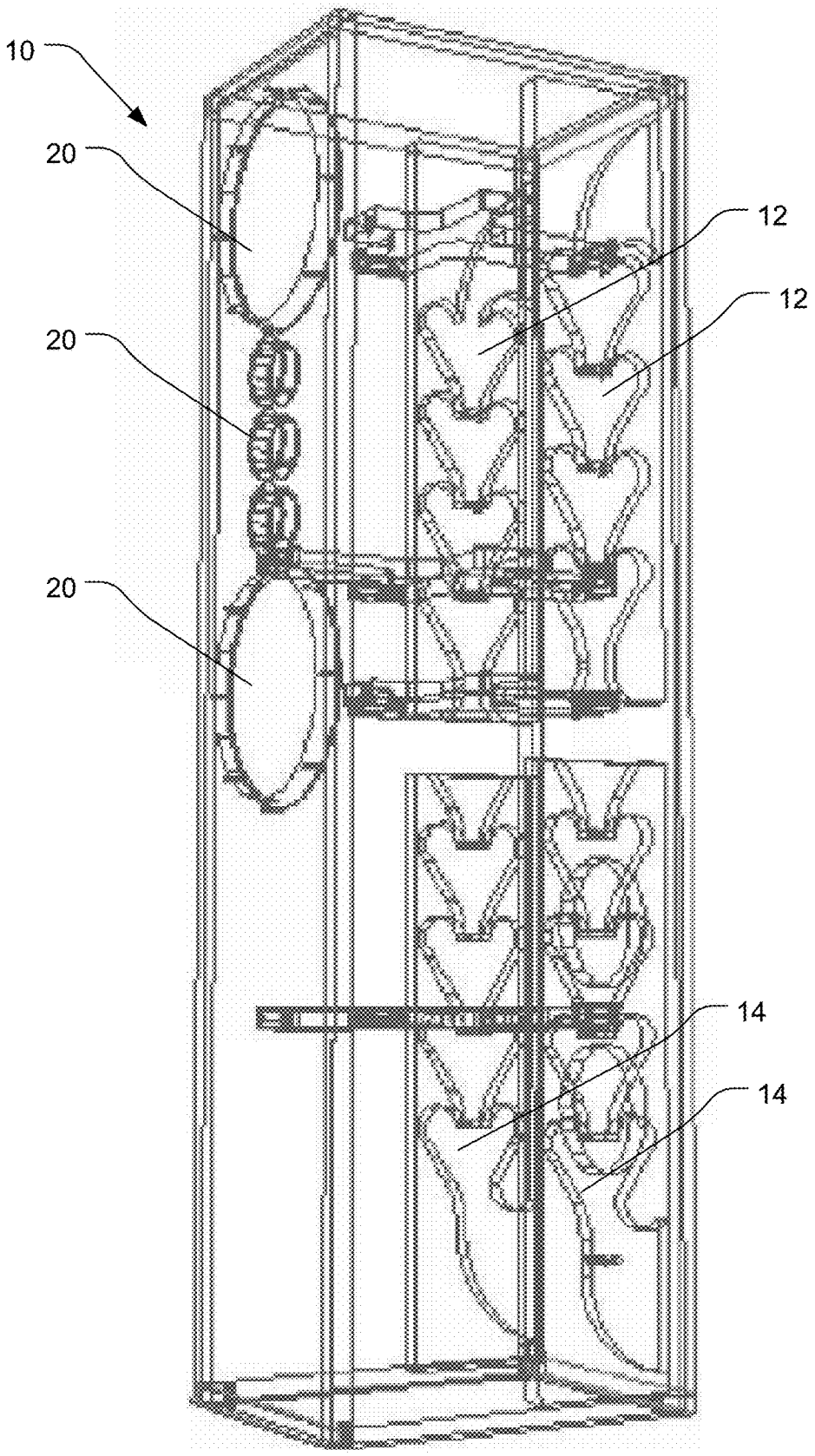
FIG. 2 shows a perspective plan view of a speaker enclosure incorporating fluid diode vents.
Figure 3:
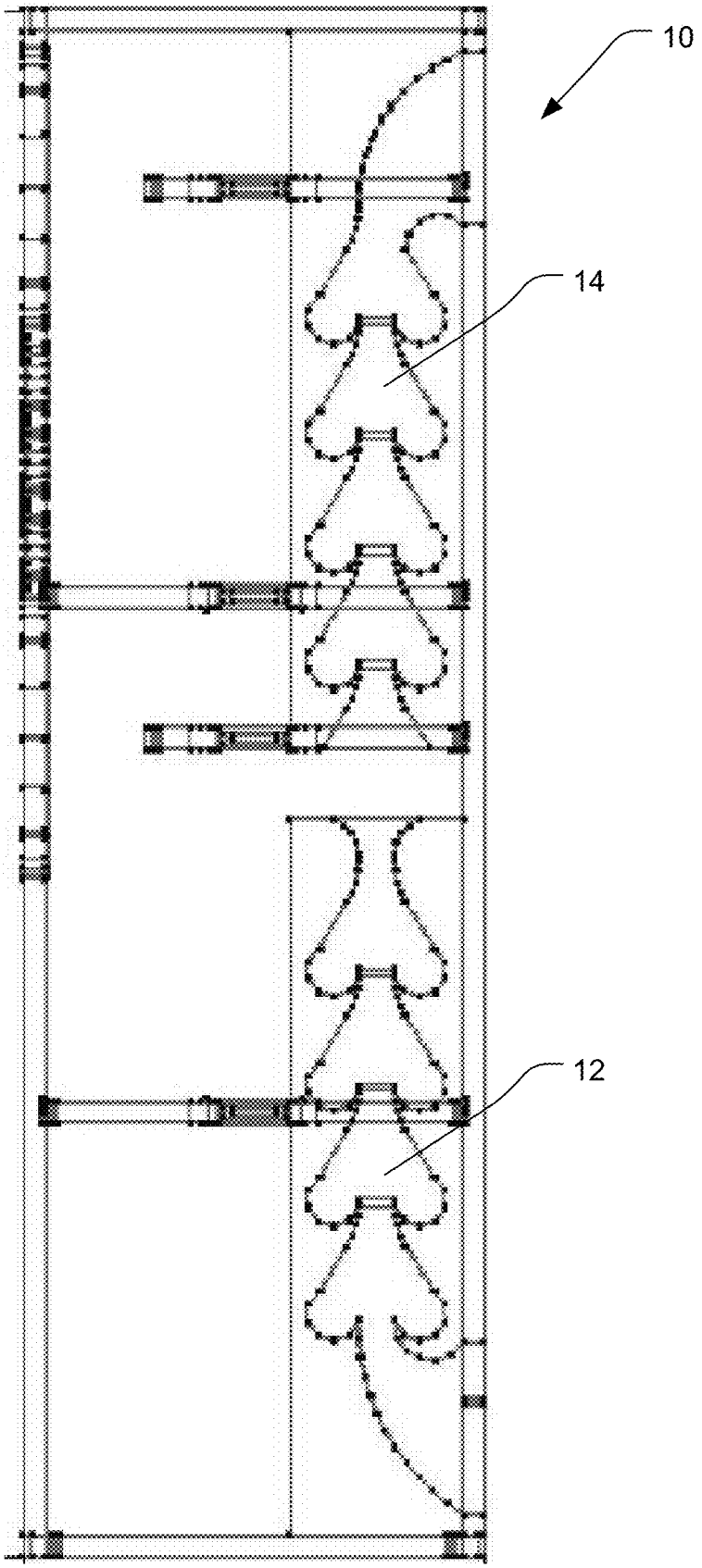
FIG. 3 shows a side plan view of a speaker enclosure incorporating fluid diode vents.
Figure 4:
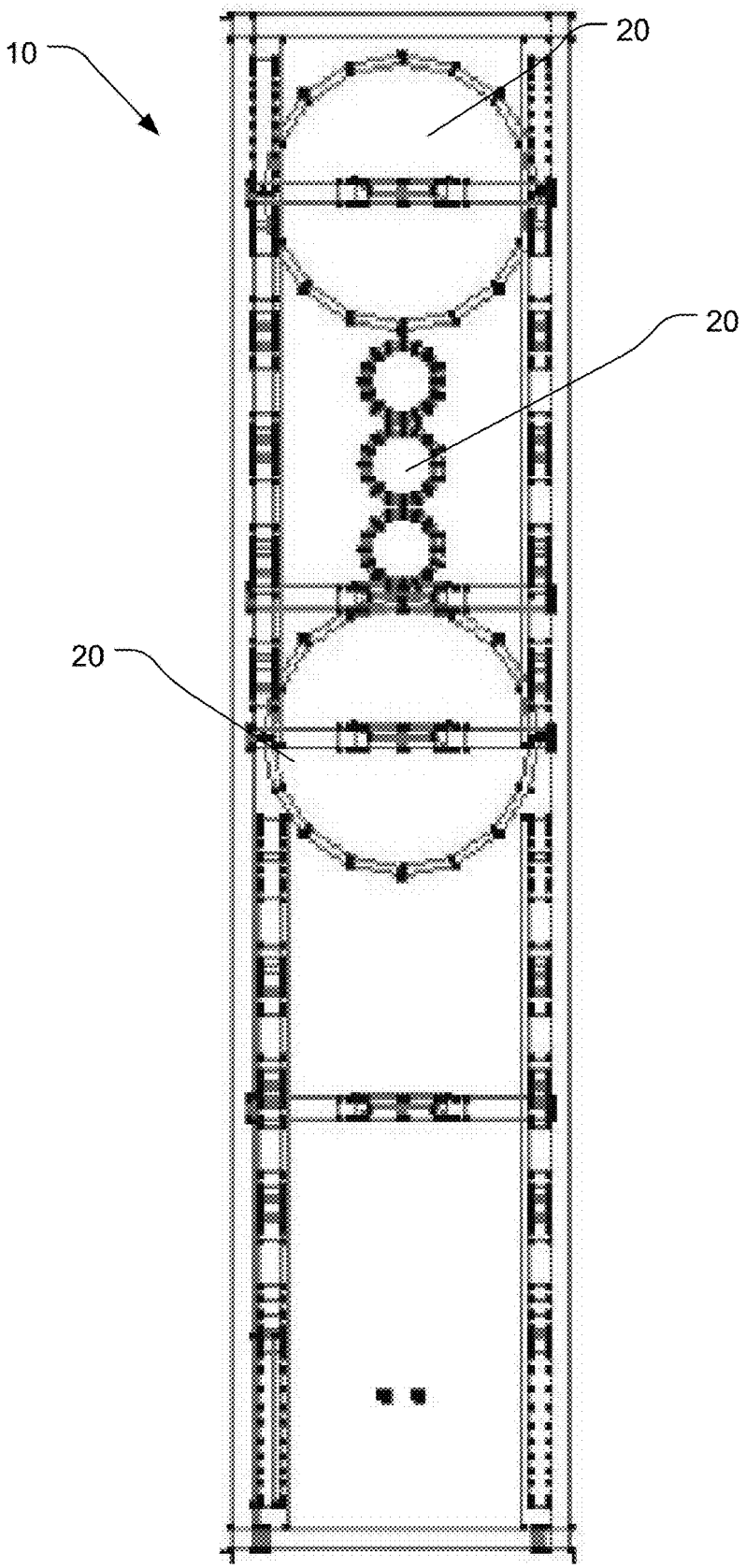
FIG. 4 shows a front plan view of a speaker enclosure incorporating fluid diode vents.
Figure 5:
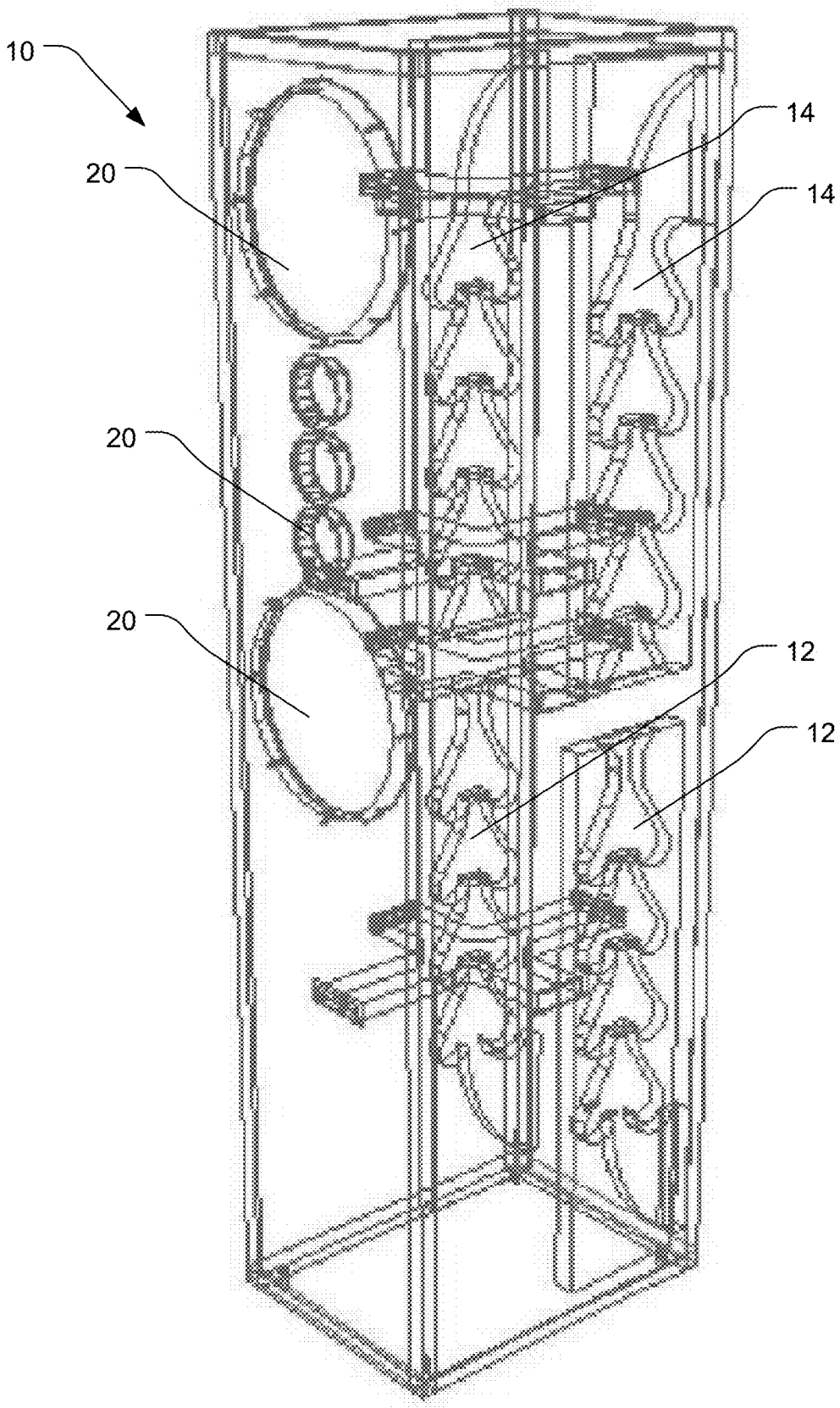
FIG. 5 shows a perspective plan view of a speaker enclosure incorporating fluid diode vents.
Figure 6:
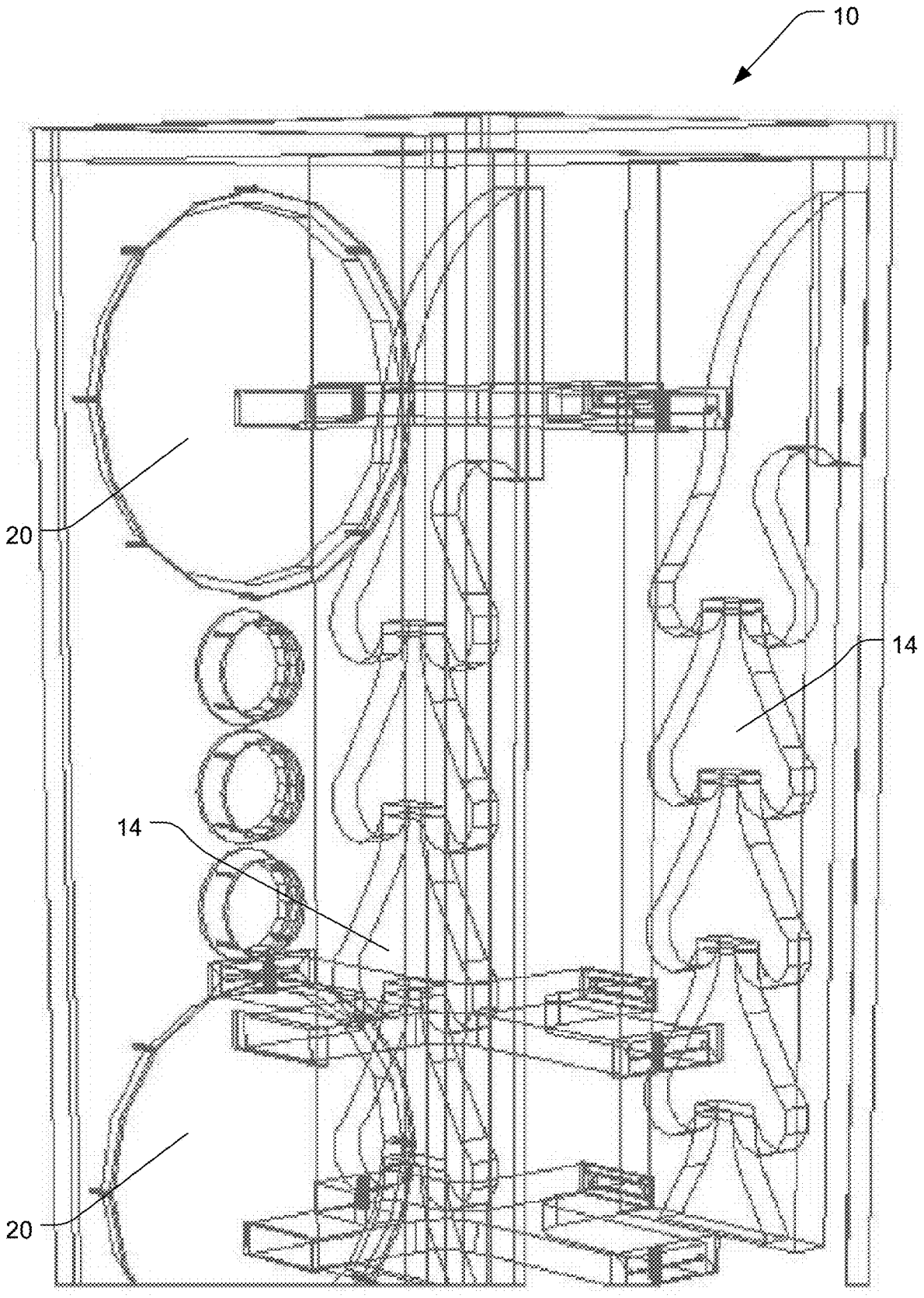
FIG. 6 shows an enlarged perspective plan view of an upper portion of a speaker enclosure incorporating fluid diode vents.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a loudspeaker incorporating a fluid diode in the air path of a speaker enclosure, allowing the internal loudspeaker enclosure air density and pressures to be fluidically controlled and cycled through the loudspeaker enclosure. Air may be drawn into the enclosure through one fluid diode, and may be pushed out of the enclosure through a second fluid diode. Such an enclosure breathes fluidically over prior methods of damped spring models, pulsing transmission lines, and pulsing resonating vents.

According to embodiments of the invention, a loudspeaker enclosure includes a fluid diode. The fluid diode may be formed between two rigid members. One of the rigid members may be an exterior panel of the loudspeaker enclosure. The fluid diode may be machined into at least one of the rigid members. The fluid diode may be substantially planar.

The loudspeaker enclosure may define an interior and an exterior, and the fluid diode may provide an air channel between the interior and the exterior. The fluid diode may be an inlet fluid diode and the loudspeaker enclosure may further include an outlet fluid diode. The inlet fluid diode and the outlet fluid diode may be substantially coplanar. In some embodiments, the loudspeaker enclosure includes four fluid diodes. Two of the fluid diodes may be inlet fluid diodes, and two of the fluid diodes may be outlet fluid diodes.

According to further embodiments of the invention, a loudspeaker includes an enclosure defining an interior and an exterior of the enclosure, one or more drivers affixed to the enclosure, and a port venting an interior of the enclosure to an exterior of the enclosure through a fluid diode. The fluid diode may be formed between two rigid members. One of the rigid members may be an exterior panel of the enclosure.

The fluid diode may be an inlet fluid diode and the loudspeaker may further include an outlet fluid diode. The inlet fluid diode and the outlet fluid diode may be substantially coplanar. The loudspeaker may include four fluid diodes. Two of the fluid diodes may be inlet fluid diodes, and two of the fluid diodes may be outlet fluid diodes. Each of the fluid diodes may be in fluid communication at a first end with a port of the enclosure and in fluid communication at a second end with the interior of the enclosure.

According to still further embodiments of the invention, a loudspeaker includes an enclosure defining an interior and an exterior of the loudspeaker, one or more drivers affixed to the enclosure and having an open back in fluid communication with the interior of the enclosure. The loudspeaker further includes an inlet port venting the interior of the enclosure to the exterior of the loudspeaker through a first fluid diode arranged to have increased resistance to air flow out of the enclosure through the first fluid diode as compared to air flow into the enclosure through the first fluid diode and an outlet port venting the interior of the enclosure to the exterior of the loudspeaker through a second fluid diode arranged to have increased resistance to air flow into the enclosure through the second fluid diode as compared to air flow out of the enclosure through the second fluid diode. The inlet port may be a first inlet port and the outlet port may be a first outlet port, and the loudspeaker may further include a second inlet port venting the interior of the enclosure to the exterior of the loudspeaker through a third fluid diode arranged to have increased resistance to air flow out of the enclosure through the third fluid diode as compared to air flow into the enclosure through the third fluid diode and a second outlet port venting the interior of the enclosure to the exterior of the loudspeaker through a fourth fluid diode arranged to have increased resistance to air flow into the enclosure through the fourth fluid diode as compared to air flow out of the enclosure through the fourth fluid diode.

FIGS. 1-7 show views of illustrative loudspeaker enclosures 10 having fluid diode vents in accordance with embodiments of the invention. Specifically, the illustrated loudspeaker enclosure 10 of FIGS. 1 and 2 includes two inlet fluid diodes 12 or inlet fluid diode vents, one on each side of an upper portion of the loudspeaker enclosure 10, and two outlet fluid diodes 14, one on each side a lower portion of the loudspeaker enclosure 10. In the illustrated embodiments of FIGS. 3, 5, and 6, the illustrated speaker enclosure 10 includes two inlet fluid diodes 12, one on each side of a lower portion of the loudspeaker enclosure 10, and two outlet fluid diodes 14, one on each side of an upper portion of the loudspeaker enclosure 10. Thus, it can be understood that the fluid diodes 12, 14 may be oriented and numbered in any desired manner for performance, aesthetic, or other reasons.

In the illustrated embodiments, each fluid diode 12, 14 is a substantially planar device formed as a narrow channel sandwiched between two rigid members (e.g., medium density fiberboard panels). In some embodiments, one of the rigid members is an exterior panel of the loudspeaker enclosure 10. The channel of the fluid diode 12, 14 may be formed in one or both rigid members (e.g., via CNC machining), or it may be formed or carved into a third rigid member sandwiched between the other two rigid members. Each narrow channel has a shape with protrusions formed therein so as to form a fluid diode that allows air flow in a single direction while largely resisting air flow in the other direction. Such a fluid diode may be referred to as a Tesla fluid diode. While one exemplary fluid diode shape is shown, it should be understood that other shapes of fluid diodes may be used.

While the illustrated embodiments include two inlet fluid diodes 12 and two outlet fluid diodes 14, other embodiments may include only a single inlet fluid diode 12 and/or only a single outlet fluid diode 14. Similarly, other embodiments may include three or more inlet and/or outlet fluid diodes 12, 14. Thus, the illustrated embodiment is intended only to illustrate features of embodiments of the invention and is not intended to be limiting.

The dual diode cabinet allows the internal loudspeaker enclosure air density and pressures to be fluidically controlled and cycled through the loudspeaker enclosure. Air is drawn into the enclosure through one diode 12 (or pair of diodes 12, etc.) and air is then pushed out of the enclosure through a second diode 14 (or pair of diodes 14, etc.). Each 360-degree cycle of the pistonic action of the transducer will produce an input of fresh air and the exhaling of used internal air.

The term "balanced transmission line" may be used to describe this process. The fundamental most rudimentary embodiment of the invention is the production of uniform air flow through the loudspeaker enclosure smoothly and fluidically. This enclosure breathes fluidically over the common prior art methods of damped spring models, pulsing transmission lines, and pulsing resonating vents.

Each loudspeaker enclosure 10 may include one or more speaker holes 20 adapted to receive a transducer or driver therein. The speaker holes 20 may be sized and positioned as is known in the art to achieve a desired loudspeaker performance. Any transducers (e.g., woofers) that have an open back may contribute to the movement of air to and from the interior of the loudspeaker enclosure from and to the exterior of the loudspeaker enclosure. The number, size, and placement of the speaker holes 20 may be varied as desired.

When the woofer (transducer, or other driver) is pushing outward the fresh air is being internally pulled into the enclosure 10 through the unrestricted fluid diode 12 or diodes 12 while the diode action of the opposing fluid diode 14 or diodes 14 simultaneously impedes/resists air pressure from entering the enclosure through the opposing fluid diode 14 or diodes 14. Then, as the woofer (transducer) completes the next half-cycle the woofers piston is next pulled inward into the enclosure 10 by its motor and the internal airflow is reversed; in this mode and phase of the half-cycle internal air pressure forces an airflow and escape out of the enclosure 10 through the fluid diode 14 or fluid diodes 14 and the diode action of the opposing fluid diode 12 or fluid diodes 12 simultaneously impedes/resists air pressure from being pushed out through the opposing fluid diode 12. Thus, air flow through the fluid diodes 12, 14 is substantially unidirectional.

Figure 7:
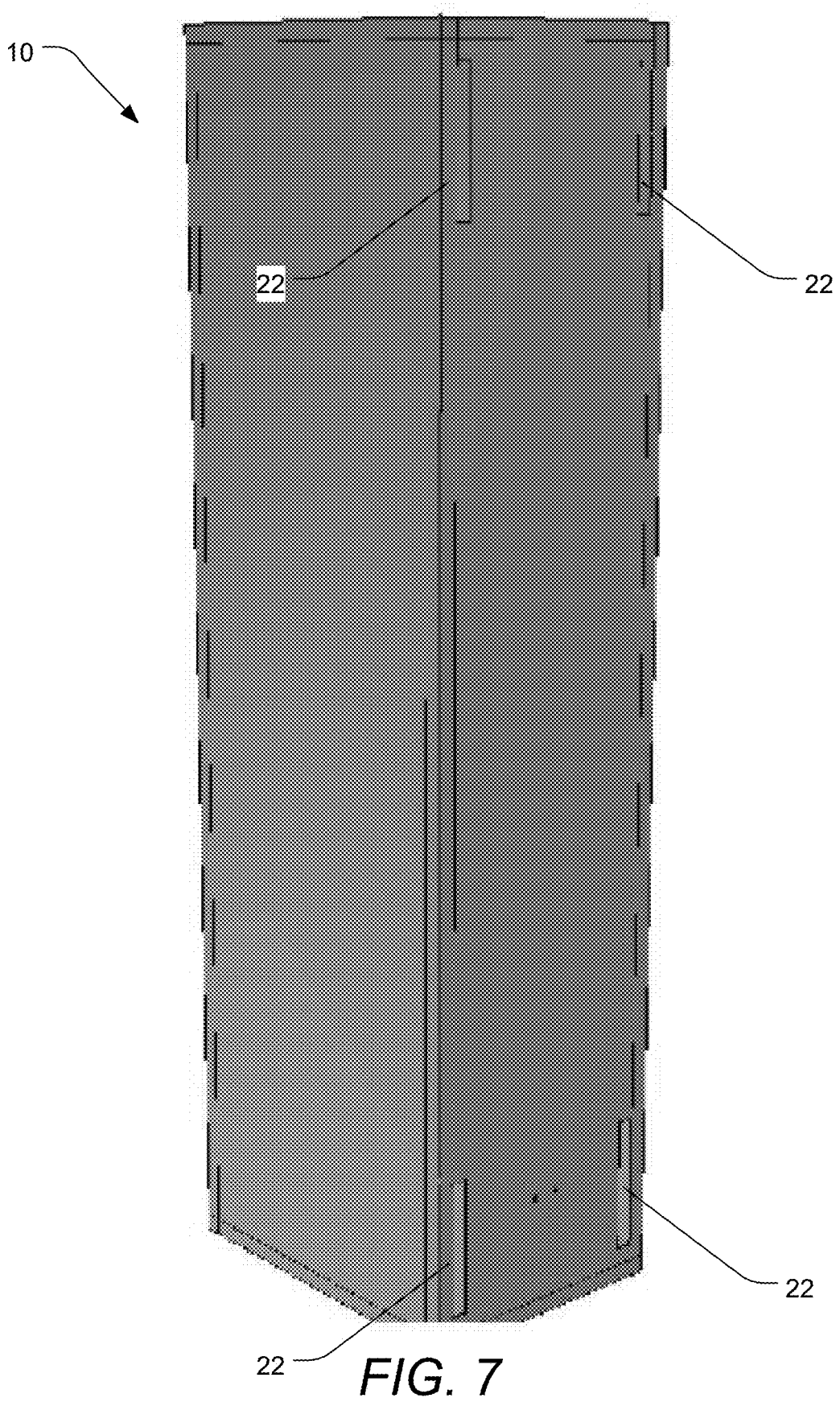
FIG. 7 shows a perspective back view of a speaker enclosure incorporating fluid diode vents.

In the illustrated embodiments, the fluid diodes 12, 14 are provided in pairs, with one inlet fluid diode 12 and one outlet fluid diode 14 provided on each side of the loudspeaker enclosure 10. The inlet fluid diode 12 and the outlet fluid diode 14 of each side of the loudspeaker enclosure 10 in the illustrated examples are substantially coplanar. As shown in FIG. 7, each fluid diode 12, 14 terminates at the external surface of the loudspeaker enclosure 10 as a port 22. The ports 22 may be rearward facing so as to minimize their visibility under normal use. That said, the ports 22 and the fluid diodes 12, 14 may be located and arranged in any desired fashion, and rearward-directed ports are not required.

Figure 8:
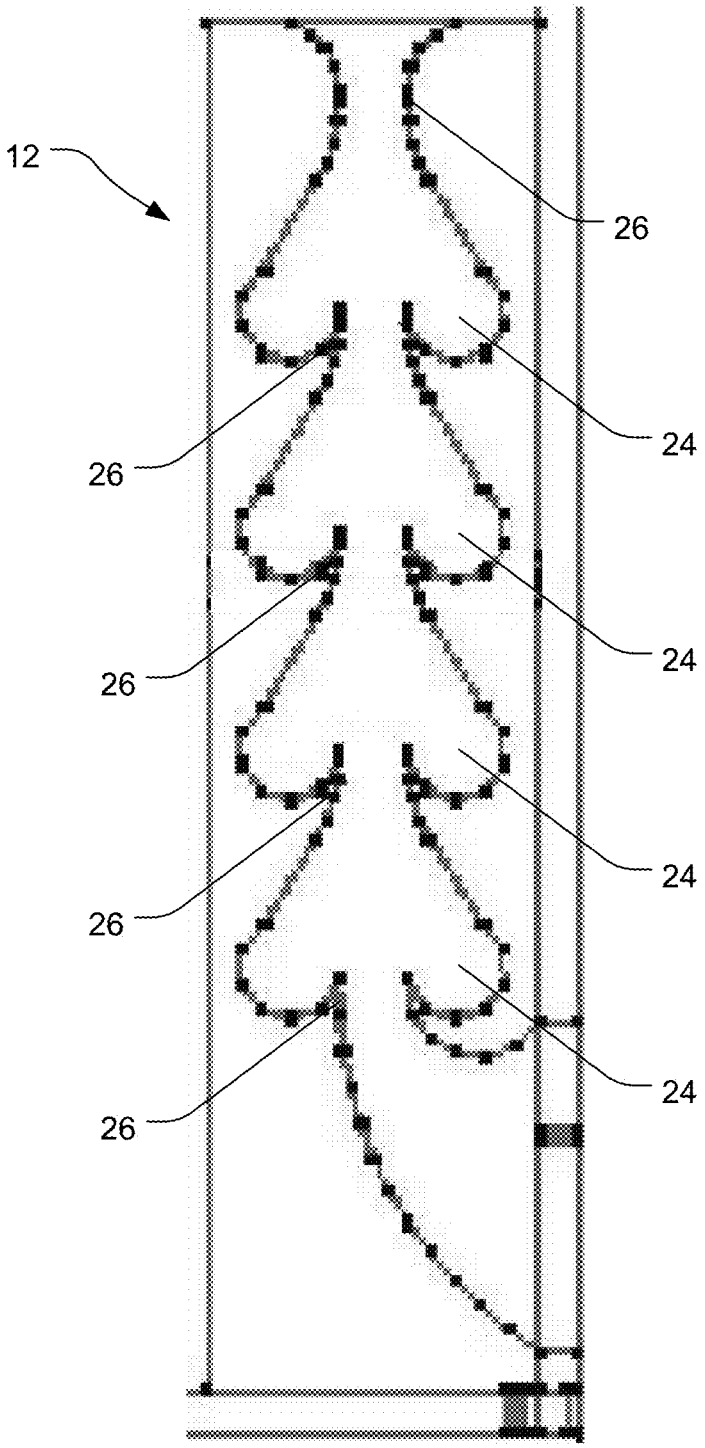
FIG. 8 shows a plan view of an illustrative fluid diode vent.

FIG. 8 shows an expanded plan view of an exemplary inlet fluid diode 12 in accordance with the embodiments discussed above. The fluid diode 12 in this example is formed as four separate lobes 24 separated from adjoining areas by constrictions 26. The shape of the lobes 24 and constrictions 26 permits relatively unimpeded air flow in one direction (in this case bottom to top) while significantly impeding the flow of air in the opposite direction (in this case top to bottom). It should be understood that embodiments of the invention embrace the use of fluid diodes having more or fewer lobes 24 and constrictions 26 and/or other geometries of fluid diodes. For example, U.S. Pat. No. 1,329,559, incorporated herein by reference, illustrates one alternate configuration or design of a fluid diode or valve.

While embodiments of the invention have been discussed with respect to exemplary loudspeaker enclosures, it should be understood that a finished loudspeaker having fluid diodes such as discussed herein is embraced within the scope of the invention as claimed below.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A loudspeaker enclosure comprising:

a first fluid diode arranged to have increased resistance to air flow out of the enclosure through the first fluid diode as compared to air flow into the enclosure through the first fluid diode; and a second fluid diode arranged to have increased resistance to air flow into the enclosure through the second fluid diode as compared to air flow out of the enclosure through the second fluid diode.

2. The loudspeaker enclosure as recited in claim 1, wherein the first fluid diode is formed between two rigid members.

3. The loudspeaker enclosure as recited in claim 2, wherein one of the rigid members is an exterior panel of the loudspeaker enclosure.

4. The loudspeaker enclosure as recited in claim 2, wherein the first fluid diode is machined into at least one of the rigid members.

5. The loudspeaker enclosure as recited in claim 1, wherein the first fluid diode is substantially planar.

6. The loudspeaker enclosure as recited in claim 1, wherein the loudspeaker enclosure defines an interior and an exterior, and wherein the first fluid diode provides an air channel between the interior and the exterior.

7. The loudspeaker enclosure as recited in claim 1, wherein the first fluid diode is an inlet fluid diode and wherein the second fluid diode is an outlet fluid diode.

8. The loudspeaker enclosure as recited in claim 7, wherein the inlet fluid diode and the outlet fluid diode are substantially coplanar.

9. The loudspeaker enclosure as recited in claim 1, wherein the loudspeaker enclosure comprises four fluid diodes.

10. The loudspeaker enclosure as recited in claim 9, wherein two of the fluid diodes are inlet fluid diodes, and two of the fluid diodes are outlet fluid diodes.

11. A loudspeaker comprising:

an enclosure defining an interior and an exterior of the enclosure;

one or more drivers affixed to the enclosure; and a first port venting the interior of the enclosure to the exterior of the enclosure through a first fluid diode arranged to have increased resistance to air flow out of the enclosure through the first fluid diode as compared to air flow into the enclosure through the first fluid diode; and a second port venting the interior of the enclosure to the exterior of the enclosure through a second fluid diode arranged to have increased resistance to air flow into the enclosure through the second fluid diode as compared to air flow out of the enclosure through the second fluid diode.

12. The loudspeaker as recited in claim 11, wherein the first fluid diode is formed between two rigid members.

13. The loudspeaker as recited in claim 12, wherein one of the rigid members is an exterior panel of the enclosure.

14. The loudspeaker as recited in claim 11, wherein the first fluid diode is an inlet fluid diode and second fluid diode is an outlet fluid diode.

15. The loudspeaker as recited in claim 14, wherein the inlet fluid diode and the outlet fluid diode are substantially coplanar.

16. The loudspeaker as recited in claim 11, wherein the loudspeaker comprises four fluid diodes.

17. The loudspeaker as recited in claim 16, wherein two of the fluid diodes are inlet fluid diodes, and two of the fluid diodes are outlet fluid diodes.

18. The loudspeaker as recited in claim 17, wherein each of the fluid diodes is in fluid communication at a first end with a port of the enclosure and in fluid communication at a second end with the interior of the enclosure.

19. A loudspeaker comprising:

an enclosure defining an interior and an exterior of the loudspeaker;

one or more drivers affixed to the enclosure and having an open back in fluid communication with the interior of the enclosure;

an inlet port venting the interior of the enclosure to the exterior of the loudspeaker through a first fluid diode arranged to have increased resistance to air flow out of the enclosure through the first fluid diode as compared to air flow into the enclosure through the first fluid diode; and an outlet port venting the interior of the enclosure to the exterior of the loudspeaker through a second fluid diode arranged to have increased resistance to air flow into the enclosure through the second fluid diode as compared to air flow out of the enclosure through the second fluid diode.

20. The loudspeaker as recited in claim 19, wherein the inlet port is a first inlet port and the outlet port is a first outlet port, the loudspeaker further comprising:

a second inlet port venting the interior of the enclosure to the exterior of the loudspeaker through a third fluid diode arranged to have increased resistance to air flow out of the enclosure through the third fluid diode as compared to air flow into the enclosure through the third fluid diode; and a second outlet port venting the interior of the enclosure to the exterior of the loudspeaker through a fourth fluid diode arranged to have increased resistance to air flow into the enclosure through the fourth fluid diode as compared to air flow out of the enclosure through the fourth fluid diode.

* * * * *